US005731535A

United States Patent [19]

Hudak

[11] Patent Number: 5,731,535

[45] Date of Patent: Mar. 24, 1998

[54] PROXIMITY SENSITIVE CONTROL CIRCUIT FOR ELECTRICAL MUSICAL INSTRUMENT

[75] Inventor: William B. Hudak, Hebron, Conn.

[73] Assignee: Kaman Music Corporation, Bloomfield, Conn.

[21] Appl. No.: 782,986

[22] Filed: Jan. 14, 1997

[51] Int. Cl.[6] ..... G10H 3/10; G10H 3/14

[52] U.S. Cl. ..... 84/733; 84/741

[58] Field of Search ..... 84/600, 723, 733, 84/701, 711, 718, 741, 743, 744, 737

[56] References Cited

U.S. PATENT DOCUMENTS

| | | | |
|---|---|---|---|
| 3,749,810 | 7/1973 | Dow | 84/701 |
| 4,526,078 | 7/1985 | Chadabe . | |
| 5,300,730 | 4/1994 | Ekhaus . | |
| 5,449,858 | 9/1995 | Menning et al. . | |

*Primary Examiner*—William M. Shoop, Jr.
*Assistant Examiner*—Jeffrey W. Donels
*Attorney, Agent, or Firm*—McCormick, Paulding & Huber

[57] ABSTRACT

A control circuit for use with a guitar or other musical instrument having an electromechanical pickup for converting natural vibrations of the instrument into electrical signals amplified or otherwise conditioned by a sound system to produce a derivative sound, controls a given parameter, such as the loudness or intensity, of the derivative sound and includes one or more pads of electrically conductive material fixed to the instrument and defining one or more discrete areas on the outer surface of the instrument which are sensitive to such discrete areas being touched by or brought into close proximity to a finger, hand or other body part of the performer, thereby allowing the performer to easily and quickly make changes in the given parameter of the derivative sound.

19 Claims, 6 Drawing Sheets

PROXIMITY SENSITIVE CONTROL CIRCUIT FOR ELECTRICAL MUSICAL INSTRUMENT

FIELD OF THE INVENTION

The invention relates to guitars and other musical instruments having an electromechanical pickup for converting the natural sound vibrations of the instrument into electrical signals which are amplified and otherwise conditioned by a sound system to provide drive signals for one or more speakers or other sound reproducing devices to produce a derivative sound, which derivative sound is derived from the natural sound of the instrument but may differ from that natural sound in regard to a number of different parameters; and deals more particularly with a control system for controlling at least one of the parameters of the derived sound in response to the player of the instrument touching given discrete areas of the instrument with his hand or other body part or at least bringing his hand or other body part into close proximity with such discrete areas.

BACKGROUND OF THE INVENTION

In regard to guitars as well as other musical instruments, it is well known to provide one or more electromechanical pickups on the instrument to convert the vibrations of the strings or other parts of the instrument into corresponding electrical signals which are subsequently amplified by an associated sound system to produce a derivative sound from one or more speakers or other sound reproducers. It is also well known for the sound system to include circuits for conditioning the electrical signals to add certain effects to the speaker drive signals such as, for example, bass, treble and mid-range frequency boost or cut off, vibrato, reverberation, and various types of distortions. To control these various parameters of the drive signal, the instrument is also often provided with a number of control knobs and/or switches by means of which the player can himself exercise control over the various parameters while playing the instrument. These control knobs and switches are somewhat unhandy and difficult to operate and often preclude the player from making rapid changes in the parameters as might be desired for certain performances. Also, the knobs and switches are often unsightly, take up much room on the surface of the instrument and require the formation of mounting holes or recesses in the instrument body.

The general object of this invention is, therefore, to provide a control system for a guitar or other musical instrument whereby a given parameter, such as the intensity or volume of the derivative sound, can be varied by the player without the use of a control switch or knob but instead can be controlled by the player merely bringing his hand into touching contact or close proximity with given discrete areas of the guitar.

A further object of the invention is to provide a control system as aforesaid whereby the player of the instrument can make rapid changes in the involved parameter of the derivative sound during a performance and whereby no mounting holes or recesses need be provided in the instrument for accommodating the control elements.

Other objects and advantages will be apparent from the following description of a preferred embodiment and from the accompanying drawings and claims.

SUMMARY OF THE INVENTION

The invention resides in a musical instrument having an outer surface, in combination with a proximity sensor at least a part of which sensor is carried by the musical instrument, the sensor having a pad of electrically conductive material fixed relative to a discrete part of the outer surface of the instrument so that when a human body part moves into close proximity with that discrete part of the outer surface, the electrically conductive pad and the body part form a capacitance to which the proximity sensor is sensitive.

The invention also resides in the proximity sensor being part of an electromechanical system for creating a derivative sound from the sound vibrations generated by the instrument, the electromechanical system including an electrical circuit for varying at least one parameter of the derivative sound and the proximity sensor being part of such electrical circuit.

The invention also resides in the proximity sensor being one of several sensors used to control a parameter of the derivative sound with each proximity sensor when touched or brought into close proximity to a body part of the player operating to set the involved parameter to a given degree or level of intensity.

The invention also resides in other detailed features of the combination as set forth in the appended claims.

DETAILED DESCRIPTION OF THE PREFERRED EMBODIMENT

The invention may be used with various types of electrified musical instruments and may be used in connection with various different parameters of the derivative sound produced by the associated sound system. For a given parameter, the control system may include as few as one discrete sensitive surface area of the instrument for turning the involved parameter on and off. For example, the parameter may be a vibrato effect with the player touching one sensitive discrete area of the instrument to bring the vibrato effect into play and with the player touching the other discrete area to turn off the vibrato effect. In other cases, for a controlled parameter, a number of discrete sensitive areas of the guitar may be provided with one area being used to turn the parameter off and the other areas being used to turn the parameter on to various different degrees of intensity. For the purposes of the present description, the involved musical instrument is shown to be a hollow-bodied guitar, the controlled parameter is taken to be the volume or loudness of the derivative sound, and the control circuit for the volume is taken to include eight separate proximity sensors serving to set the volume to eight different degrees of intensity, one of which is "off" or "infinite attenuation".

Figure 1:
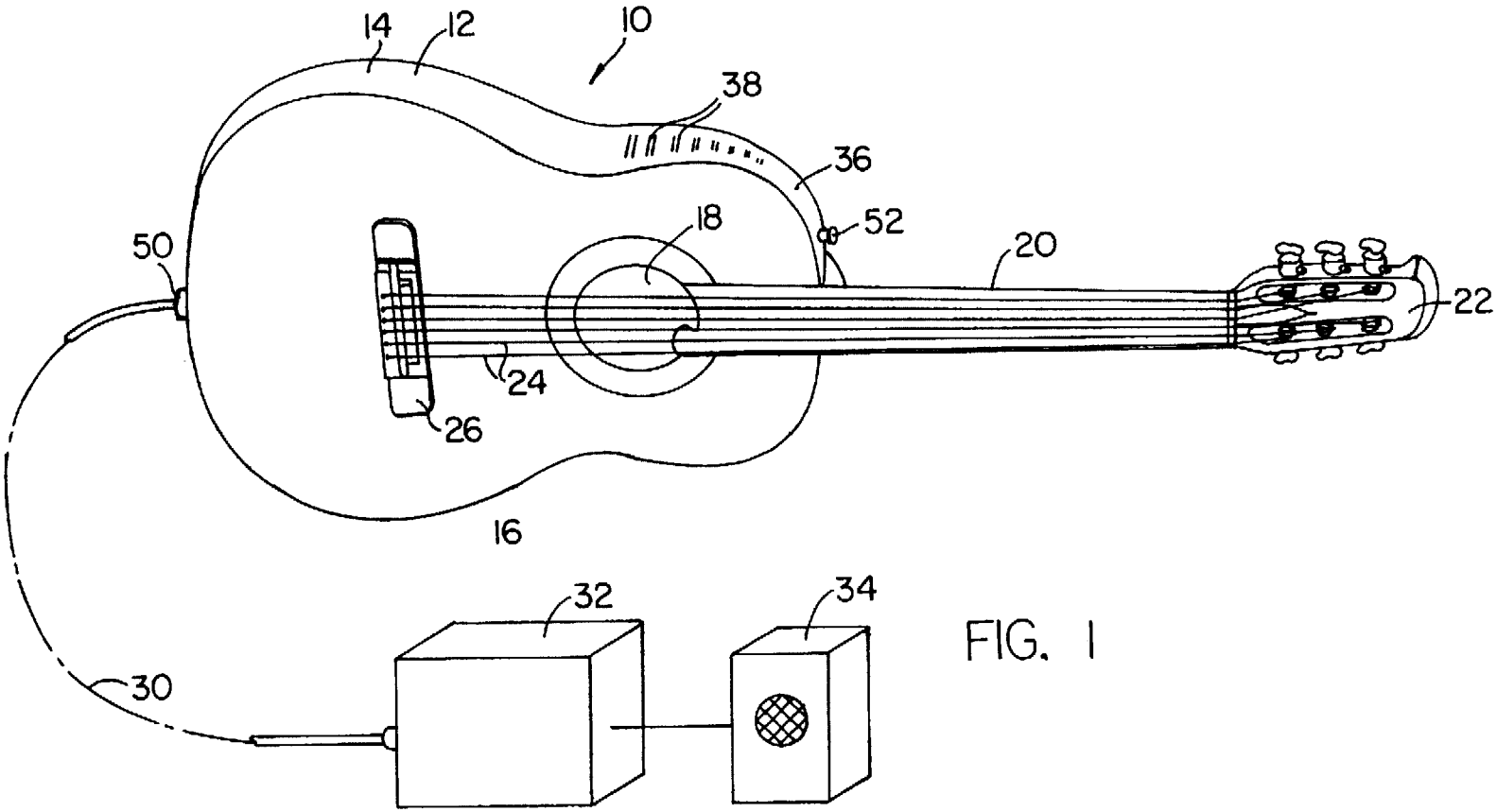
FIG. 1 is a perspective view of a guitar embodying the invention in association with a sound system, parts of which sound system are external to the guitar, for creating a derivative sound.

Referring to FIG. 1, a guitar embodying the invention is shown generally at 10 and includes a hollow body 12 comprised of a bowl shaped back 14 and a flat top plate 16 with a sound hole 18. A neck 20 extends upwardly from the body 12 and terminates in a head stock 22 supporting the ends of six strings 24 which at their other ends terminate at a combined bridge and tail piece 26 carrying a built in piezoelectric pickup, shown at 28 in FIGS. 4 and 8.

The piezoelectric pickup 28 produces electric voltage signals related to the vibrations of the strings 24 and these pickup signals are converted by an associated sound system into a derivative sound. All or some portions of the sound system may be included in the body 12 of the guitar, but in the embodiment shown by the drawings only a portion of the sound system is included in the body of the guitar and the remainder of the system is located remotely from the guitar and is connected with the guitar by a transmission cable 30, the remotely located portions of the system being a main amplifier 32 and a speaker 34. As explained in more detail hereinafter, the control system includes eight discrete areas on the outside surface of the guitar 10 each of which, when touched, or brought into close proximity with a body part of the player, sets the volume of the output derivative sound produced by the speaker 34 to an associated level of intensity. These discrete areas are preferably located so as to be easily reachable by the strumming hand of the player.

Figure 6:
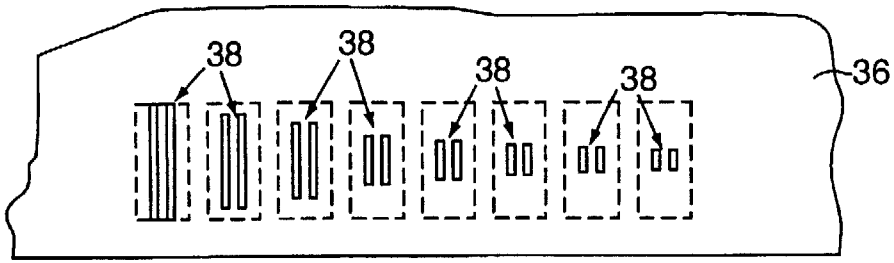
FIG. 6 is a fragmentary plan view of the body of the guitar of FIG. 1 showing the markings provided on the outside of the body to indicate to the player the locations of the underlying pads of the proximity sensitive sensors.

In the illustrated case, the guitar 10 has upper and lower bouts with the bowl 14 of the body having a sidewall including a portion 36 located on the bass side of the upper bout, and the discrete sensitive areas of the outer surface of the guitar are located on this sidewall portion 36 and are marked by suitable markings 38, shown more clearly in FIG. 6. Each marking 38, for example and as illustrated, consists of two parallel color strips of material applied to the outer surface of the guitar with the lengths of the strips being related to the volume level associated with the corresponding discrete area. That is, in FIG. 6 the rightmost marking 38 having the shortest length corresponds to the volume being turned off, the leftmost marking 38 of longest length corresponds to the volume being turned on to its highest level, and the intermediate markings 38 correspond to the volume being turned on to various intermediate levels.

Figure 2:
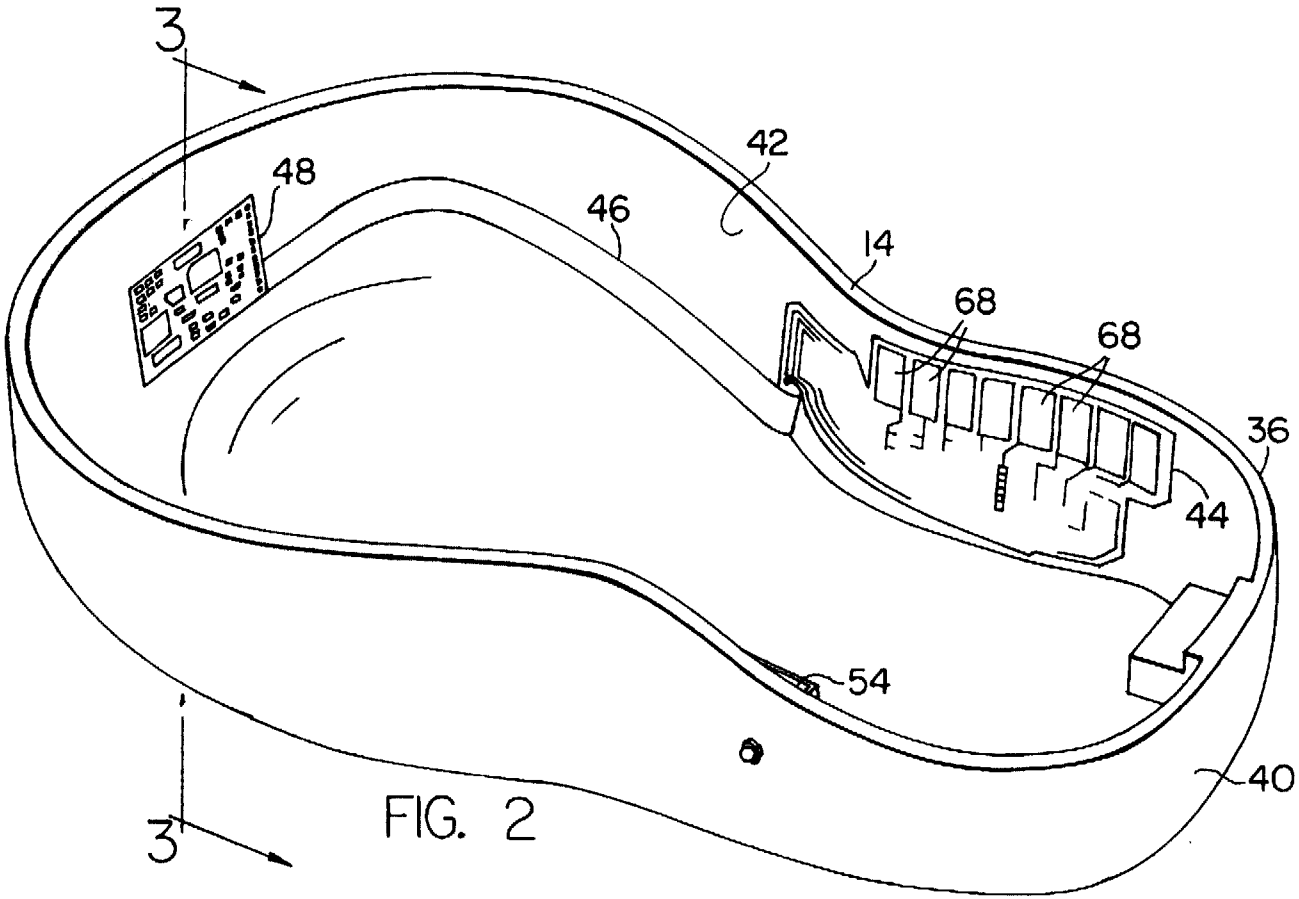
FIG. 2 is a perspective view showing the body of the guitar of FIG. 1 with its top plate removed.
Figure 3:
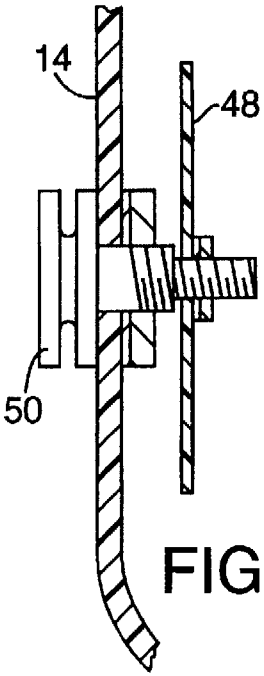
FIG. 3 is a fragmentary sectional view taken generally on the line 3—3 of FIG. 2.

With reference to FIGS. 2 and 3, the guitar bowl 14 has an outer surface 40 and an inner surface 42 conforming generally to the shape of the outer surface 40, the bowl being made of a relatively thin dielectric composite material. The parts of the sound system contained in the guitar body include a flexible circuit board 44 adhered to the inside surface 42 along the inside of the bass side upper bout sidewall portion 36. Part of the flexible circuit board 44 is a connecting strip or cable 46 connecting the major portion of the circuit board 44 to a rigid preamplifier circuit board 48. The circuit board 48, as shown in FIG. 3, is carried and supported by a part 50 which serves not only as the support for the circuit board 48 but also as a connector for a supporting strap or sling for the guitar which may have one end connected to the part 50 and its other end connected to a button 52 fixed to the upper end of the guitar body as shown in FIG. 1; and the part 50 also serves as a female jack part for releasable connection with a cooperating male jack part carried by the transmission cable 30. Also included in the guitar body 12 is a battery holder 54 carrying a 9V battery which can be inserted into and removed from the holder by reaching through the sound hole 18.

Figure 4:
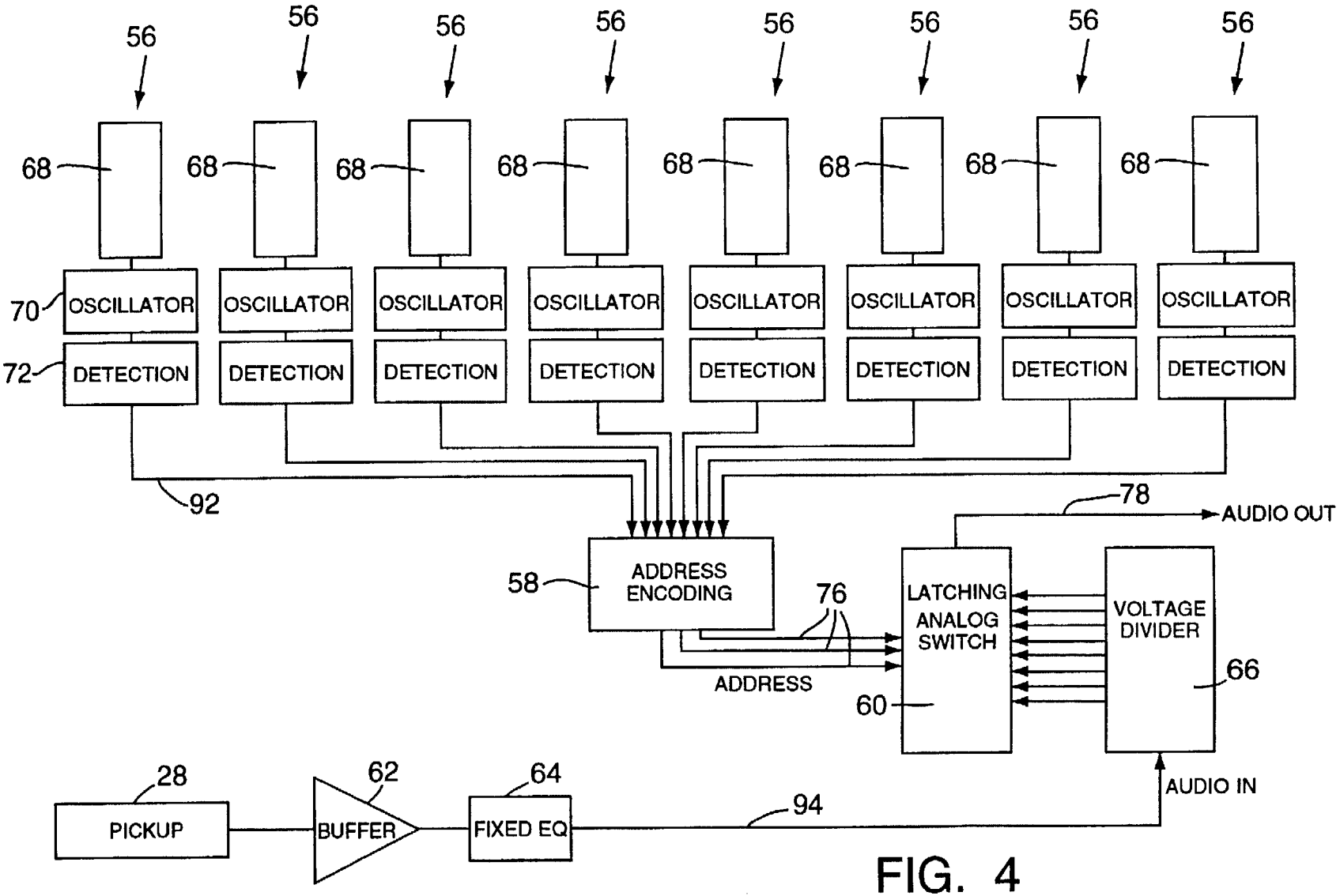
FIG. 4 is a block diagram of the electrical circuitry included in the body of the guitar of FIG. 1.

Referring to FIG. 4, the major components of the control circuit carried by the guitar body include a set of eight proximity sensing circuits, each indicated generally at 66, an address encoding circuit 58, a latching analog switch 60, the pickup 28, a buffer 62, a fixed equalization circuit 64 and a voltage divider 56.

Still referring to FIG. 4, each proximity sensor 56 includes a generally rectangular copper pad 68 which underlies and defines the associated discrete area of the outside surface of the guitar. Connected with the pad 68 is an oscillator 70 which normally runs at a fixed frequency such as, for example, 500 KHz. The copper pad 68 is connected with the frequency determining circuit of the oscillator 70 and when a finger or hand of the player touches or comes into close proximity to the pad 68, the pad 68 and the body part, separated by the dielectric wall of the guitar body 14, form a capacitance which changes the time constant of the oscillator 70 and causes the oscillator to shift from its normal frequency to a higher frequency. A detection circuit 72 associated with the oscillator detects the frequency shift and produces, on an output line 92, a signal in the form of a voltage spike in response to the frequency shift. The address encoding circuit 58 responds to the voltage spike by producing a three-bit address on the address lines 76 designating the particular one of the proximity sensing circuits 56 producing the voltage spike. The three-bit address is supplied to the latching switch 60, which is a three-bit, addressable octal switch, receiving eight inputs from the voltage divider circuit 66.

The voltage divider 66 is connected with the pickup 28 through the buffer 62 and fixed equalization circuit 64 to produce an AUDIO IN signal supplied to the voltage divider 66. An AUDIO OUT signal is taken from the latching analog switch 60 and is supplied to the transmission line 30 through the output jack part 50. The AUDIO IN signal represents the maximum possible value of the AUDIO OUT signal and the voltage divider 66 in addition to one tap providing the full value of the AUDIO IN signal contains seven other taps providing different lesser portions of the AUDIO IN signal, with one of those other seven taps providing an off signal. Each of the eight different levels of audio signal provided by the voltage divider 66 corresponds to a respective one of the proximity sensing circuits 56 and the latching analog switch 60 serves to connect the appropriate one of the voltage divider outputs to the audio output line 78 in response to the identifying address appearing on the address lines as 76.

Figure 5:
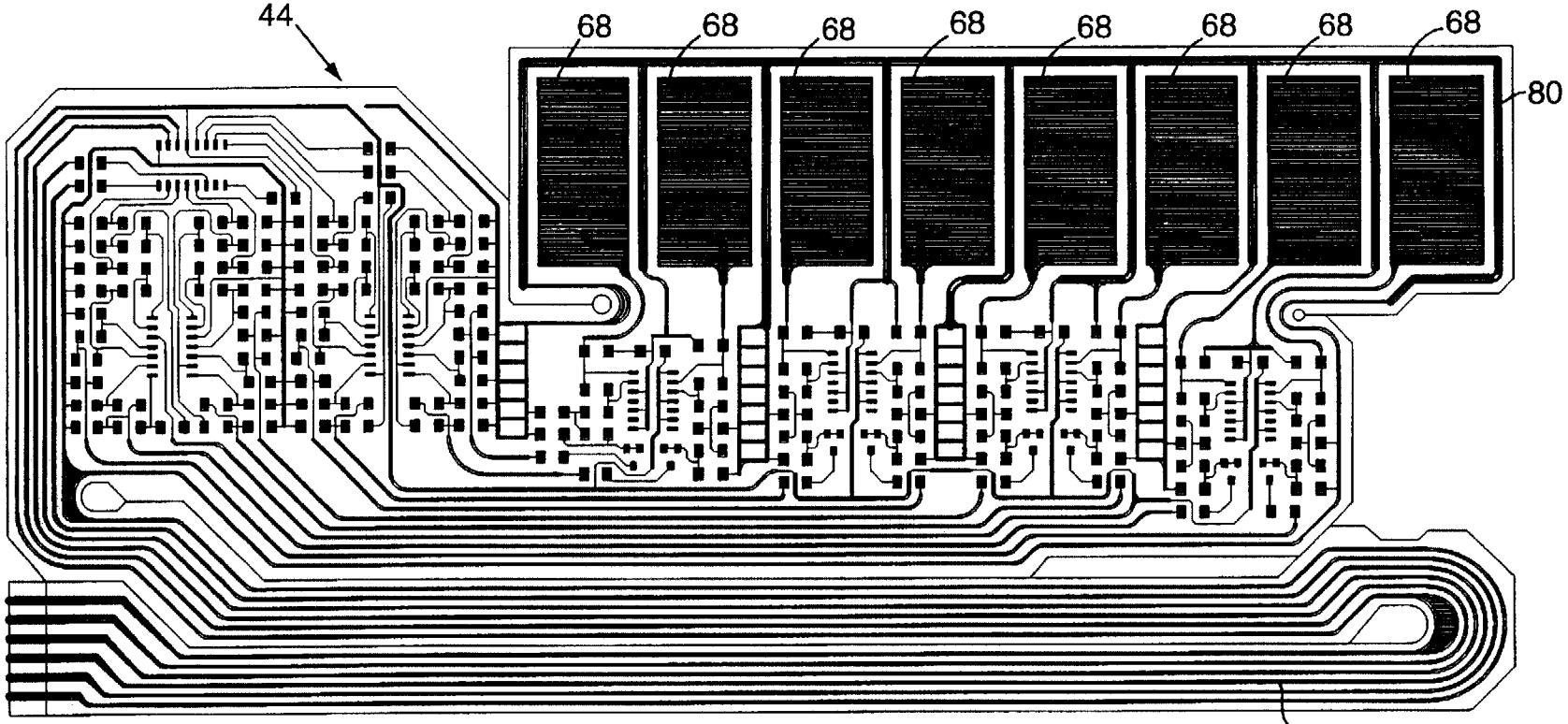
FIG. 5 is a plan view of the flexible printed circuit board forming part of the circuitry included in the guitar of FIG. 1.
Figure 7:
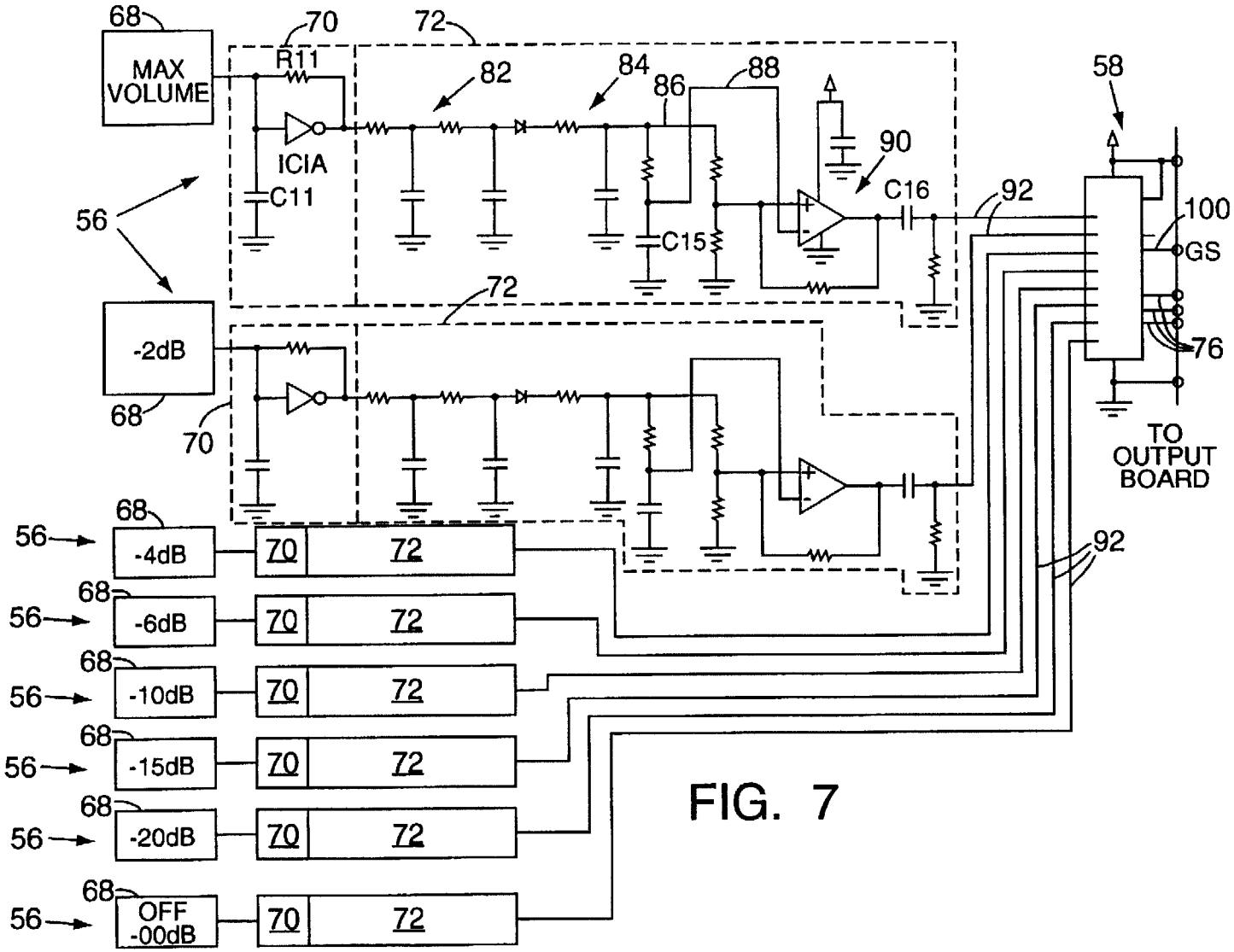
FIG. 7 is a circuit diagram of the circuitry included on the printed circuit board of FIG. 5.

FIG. 7 is a circuit diagram showing the circuit components contained on the flexible circuit board 44. These components include the eight proximity sensing circuits 56 and the address encoding circuit 58 of FIG. 4. A plan view of the flexible circuit board itself is shown in FIG. 5 from which it will be noted that each copper pad 68 is surrounded in large part and separated from the other pads 68 by a ground conductor 80 which serves to electrically isolate the pads 68 from one another. FIG. 5 shows the printed circuit board before the addition to it of integrated circuit modules and other components of the associated circuits, and the portion of the board 44 which forms the connecting strip 46 is shown still connected with the remainder of the board. Before the board is attached to the inside surface of the guitar bowl, the portion forming the strip 46 is appropriately cut to allow the strip 46 to extend to the preamplifier board 48.

As shown in FIG. 7, each of the proximity sensing circuits 56 includes its associated copper pad 68, and in the figure, each pad 68 is marked to indicate the volume of the AUDIO OUT signal associated with it. That is, the uppermost pad 68 corresponds to the maximum intensity of the AUDIO OUT signal, the second pad 68 from the top corresponds to an intensity level down 2dB from the maximum volume, and the remaining six pads 68 correspond respectively to other decreasing levels of intensity with the bottommost pad 68 corresponding to an off level of intensity.

Referring to the topmost proximity sensing circuit 56 of FIG. 7, the oscillator 70 includes a Schmidt trigger inverter ICIA and a normal running frequency determining circuit comprised of a resistor R11 and capacitor C11 which, in the present instance, cause the oscillator to run at a fixed frequency of approximately 500KHz. The copper pad 68 is connected with this timing circuit and normally has no effect on the oscillator frequency. However, when the hand of the player touches or comes close to the corresponding discrete area of the outside surface of the guitar, the player's body forms a capacitance with the pad 68 with the player serving as a charge-carrying body. As a result of this, the time constant of the frequency determining circuit is decreased and the running frequency of the oscillator is increased.

The detection circuit 72 of the top proximity sensing circuit 56 of FIG. 7 includes a two-stage low pass filter 82 and a rectifying and filtering circuit 84. The output of the circuit 84, which appears on the line 86, is of a steady voltage level when the oscillator 70 is running at its normal frequency and the capacitor C15 maintains a corresponding voltage value on the line 88. When the frequency of the oscillator 70 shifts, the value of the voltage on the line 86 immediately increases but the value of the voltage on the line 88 does not immediately increase due to the voltage holding effect of the capacitor C15. A comparator 90 compares the voltages on the line 88 with a voltage related to that on the line 86 and produces an output voltage spike at C16 on the line 92 when the voltage on the line 86 shifts upwardly.

The oscillator circuits 70 and detection circuits 72 associated with the other copper pads 68 are all identical to the ones associated with the upper pad 68 of FIG. 7 and each functions to produce a voltage spike on the associated line 92 when the involved copper pad 68 is brought into proximity with the player's hand or other body part.

As shown in FIG. 7, the address encoding circuit 58 is formed by an 8-bit priority encoder module. When a voltage spike appears on one of the lines 92, the encoder 58 produces a 3-bit address on the three address lines 76 identifying the involved one of the proximity sensing circuits 56 and also produces a latch signal on the GS line 100.

Figure 8:
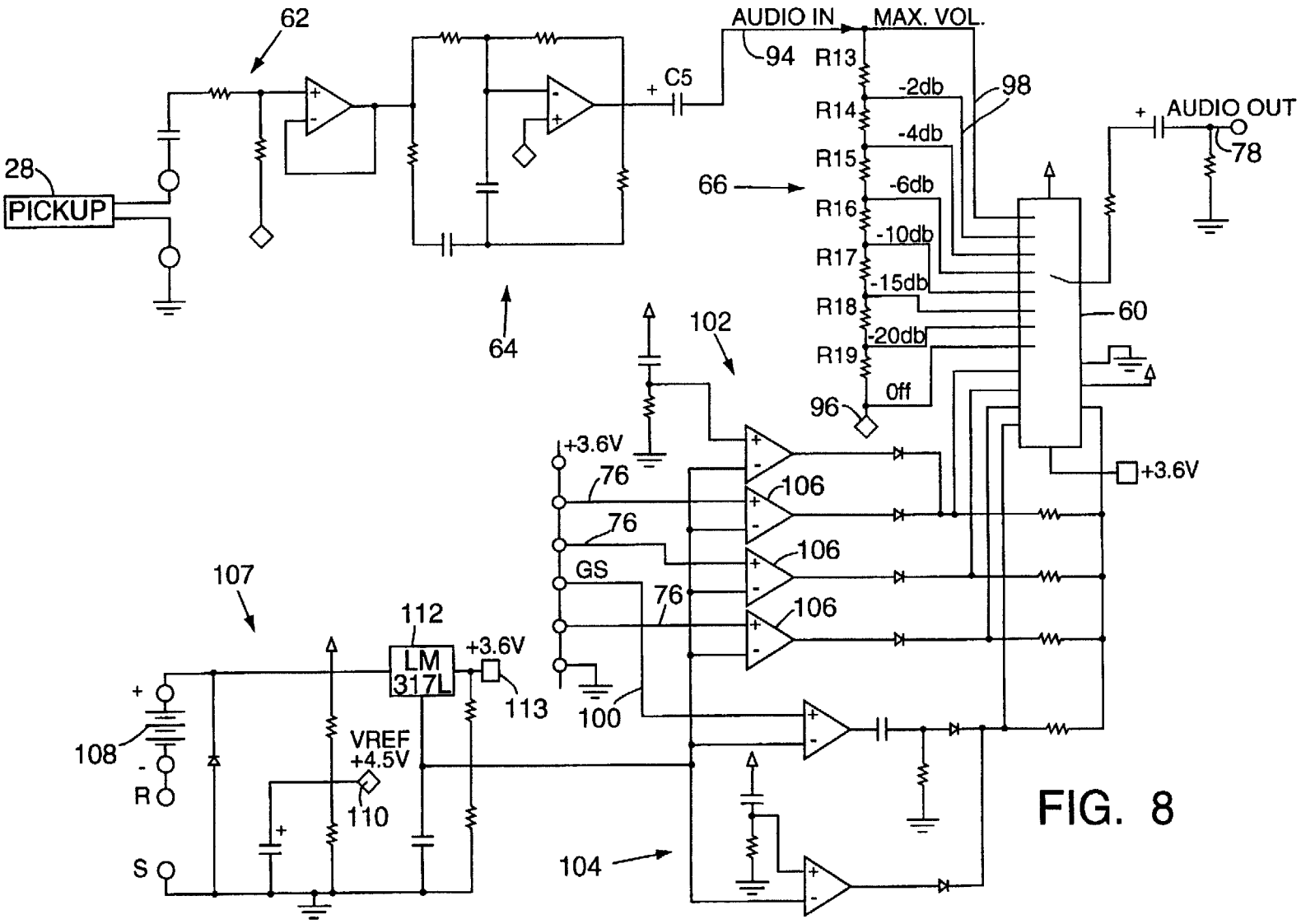
FIG. 8 is a circuit diagram of the circuitry included on the preamplifier circuit board contained in the body of the guitar of FIG. 1.

Referring to FIG. 8, the pickup 28 is connected through the buffer circuit 62, the fixed equalization circuit 64 and the coupling capacitor C5 to the AUDIO IN line 94. The AUDIO IN line 94 is in turn connected to the voltage divider 66 consisting of six resistors R13 to R19 connected in series with one another as shown between the AUDIO IN line 94 and a reference voltage terminal 96 to provide eight input lines 98 to the latching analog switch 60.

When a new address appears on the address lines 76, the encoder 58 (FIG. 7) also, as mentioned, produces a latching voltage signal on the GS line 100 which causes the latching analog switch 60 to latch onto and hold the new address until a new address appears on the address lines 76 simultaneously with a latching signal on the line 100; and, as mentioned, the address supplied to the latching analog switch 60 by the address lines 76 cause the switch 60 to connect to the AUDIO OUT line 78 the one of the output lines 98 from the voltage divider 66 corresponding to the proximity sensor circuit 56 causing the change in address. The circuit 102 and the circuit 104 in cooperation with the comparators 106 allows time for the address circuit to stabilize when the sound system is turned on by plugging the transmission cable 30 into the jack 50 and determine the start up address supplied to the switch 60.

The circuitry shown in FIG. 8 also includes a power supply circuit 107 including the battery 108 installed in the battery holder 54 of FIG. 2. The R and S terminals of the power supply circuit 107 are the ring and sleeve terminals of the female jack part 50 and when the male part of the jack, connected to the associated end of the transmission cable 30, is inserted into the jack part 50 a closed circuit is created between the R and S terminals turning on the power supply circuit 107. The battery 108 is a 9V battery and the circuit 107 includes a terminal 110 providing a V REF voltage of 4.5V. A voltage regulating module 112 maintains a supply voltage of 3.6V at another terminal 112.

Preferably, the size of the copper pads 68 are so chosen in relation to the thickness of the guitar body wall and to the values of the frequency determining components of the oscillator circuits 70 that the hand or finger of the player has to actually touch the discrete area of the outer surface of the guitar overlying a pad 68 in order for the associated proximity sensing circuit to produce an output voltage spike on the associated line 92.

I claim:

1. The combination comprising:

a musical instrument having an outer surface, and an electromechanical system for creating a derivative sound from the sound vibrations generated by said instrument, said electromechanical system including an electrical circuit for varying at least one parameter of said derivative sound, and said electrical circuit including at least one proximity sensitive sensor associated with a discrete part of said outer surface of said instrument and operable to produce an output signal indicating the presence or absence of a human body part in close proximity to said discrete part of said outer surface of said musical instrument, and means for varying said parameter in response to said output signal.

2. The combination defined in claim 1, wherein:

said musical instrument is a stringed musical instrument having a hollow body defining said outer surface.

3. The combination defined in claim 2, wherein:

said hollow body of said stringed musical instrument has an inner surface, a discrete part of which inner surface directly underlies said discrete part of said outer surface, and said proximity sensor includes a pad of electrically conductive material adhered to said discrete part of said inner surface.

4. The combination defined in claim 3, wherein:

said proximity sensor includes an oscillator having a first capacitance which determines a normal frequency of said oscillator, said electrically conductive pad being connected with said first capacitance so that when a human body part moves into proximity with said pad, said human body part and said pad effectively form a second capacitance which combines with that of said first capacitance to change the frequency of said oscillator away from said normal frequency, and means connected with said oscillator for producing said output signal, which output signal is of one value when said oscillator is operating at said normal frequency and which output signal shifts to another value when said oscillator frequency shifts to a value away from said normal frequency.

5. The combination defined in claim 2, wherein:

said parameter is one which is to be varied over a range of values, said electrical circuit includes a plurality of proximity sensors each associated with a corresponding one of a plurality of discrete parts of said outer surface of said instrument and operable to produce an output signal indicating the presence or absence of a human body part in close proximity to the associated one of said discrete parts of said outer surface of said musical instrument, and a parameter setting means, associated with said proximity sensors, for setting the value of said parameter to a predetermined value in response to a human body part moving into close proximity to an associated one of said discrete parts of said outer surface of said musical instrument, said predetermined value of said parameter being different for different ones of said discrete parts of said outer surface.

6. The combination defined in claim 1, wherein:

said musical instrument is a guitar.

7. The combination defined in claim 5, wherein:

said musical instrument is a guitar.

8. The combination defined in claim 7, wherein:

said guitar has a hollow body including a side wall with an outer surface, and said plurality of proximity sensitive sensors are associated with a corresponding plurality of discrete parts of said side wall outer surface.

9. The combination defined in claim 8, wherein:

said side wall includes an inner surface located close and parallel to said side wall outer surface, and said plurality of proximity sensors each includes an electrically conductive pad adhered to a discrete part of said inner surface directly underlying a corresponding one of said discrete parts of said outer surface.

10. The combination defined in claim 9, wherein:

said side wall outer surface includes humanly perceptible markings indicating the locations of said discrete parts of said outer surface.

11. The combination defined in claim 10, wherein:

said guitar body has bass and treble sides and an upper bout, said side wall includes a bass side upper bout portion forming part of said upper bout and located on said bass side of said body, and said discrete parts of said outer surface are located on said bass side upper bout portion of said side wall.

12. The combination defined in claim 9, wherein:

said parameter of said derivative sound is the volume of said derivative sound.

13. The combination defined in claim 1, wherein:

said proximity sensor is such that said human body part has to actually touch said discrete part of said outer surface of said instrument in order to cause said output signal to indicate the presence of said human body part in close proximity to said discrete part.

14. The combination defined in claim 9, wherein:

said electrically conductive pad of each of said proximity sensors is part of an oscillator having a first capacitance which determines a normal frequency of said oscillator, said electrically conductive pad of each of said proximity sensors is connected with said first capacitance so that when a human body part moves into proximity with said pad, said human body part and said pad effectively form a second capacitance which combines with that of said first capacitance to change the frequency of said oscillator away from said normal frequency, and each of said proximity sensors includes a means connected with the associated one of said oscillators for producing an output signal, which output signal is a one value when said oscillator is operating at said normal frequency and which output signal shifts to another value when said oscillator frequency shifts to a value away from said normal frequency.

15. The combination defined in claim 14, wherein:

said plurality of proximity sensors, including said oscillators, said electrically conductive pads and said means for producing output signals are contained on a flexible printed circuit board adhesively secured to said inner side wall surface of said guitar.

16. The combination defined in claim 15, wherein:

said electrical circuit includes a preamplifier printed circuit board located inside of said guitar body, said guitar includes a pickup for converting vibrations of the guitar string into corresponding electrical signals, said preamplifier circuit board includes a circuit connected with said pickup and operable to provide an amplified version of said pickup output signal, said preamplifier circuit board includes a voltage divider circuit having a plurality of output taps to which voltage divider circuit said amplified signal is supplied as an input, said preamplifier circuit board includes an audio output terminal, each of said taps of said voltage divider circuit is associated with a respective one of said proximity sensors, and a logic circuit operable in response to an output signal indicating the presence of a human body part in close proximity to an associated one of said discrete parts of said guitar to connect the associated one of said taps of said voltage divider circuit to said audio output terminal.

17. The combination comprising:

a musical instrument having an outer surface, and a proximity sensor at least a part of which is carried by said musical instrument, said proximity sensor including a pad of electrically conductive material fixed relative to said outer surface of said instrument so as to be associated with a discrete part of said outer surface, so that when a human body part moves into close proximity with said discrete part of said outer surface of said instrument said electrically conductive pad and said human body part form a capacitance to which said proximity sensor is sensitive.

18. The combination defined in claim 17, wherein:

said musical instrument is a guitar having a hollow body defining said outer surface and having an inner surface closely spaced and generally conforming to said outer surface, and, said electrically conductive pad is adhered to said inner surface of said guitar body.

19. The combination defined in claim 18, wherein:

said guitar includes a pickup for converting the vibrations of its strings into electrical pickup output signals, a preamplifier circuit is carried by said guitar body for converting said electrical pickup output signals to a conditioned electrical output signal, and said proximity sensor is part of a circuit for controlling the intensity of said conditioned electrical output signal.

* * * * *